US005259970A

United States Patent [19]

Kanamori et al.

[11] Patent Number: 5,259,970

[45] Date of Patent: Nov. 9, 1993

[54] AQUEOUS COMPOSITION CONTAINING WATER DISPERSED IN A LUBRICATING BASE OIL AND AT LEAST TWO SURFACTANTS

[75] Inventors: Hideo Kanamori; Toshio Saito, both of Ichihara, Japan

[73] Assignee: Idemitsu Kosan Co., Ltd., Tokyo, Japan

[21] Appl. No.: 840,096

[22] Filed: Feb. 24, 1992

Related U.S. Application Data

[63] Continuation of Ser. No. 543,400, Jun. 26, 1990, abandoned.

[30] Foreign Application Priority Data

Jun. 30, 1989 [JP] Japan ..... 1-166570
May 7, 1990 [JP] Japan ..... 2-115770

[51] Int. Cl.[5] ..... C10M 173/00; C10M 105/08; C09K 5/00

[52] U.S. Cl. ..... 252/73; 252/49.3; 252/49.5; 252/52 A

[58] Field of Search ..... 252/73, 49.3, 49.5, 252/52 A

[56] References Cited

U.S. PATENT DOCUMENTS 3,278,442 10/1966 Beerbower et al. ..... 252/75
3,296,129 1/1967 Scheidker et al. ..... 252/33.4
3,928,215 12/1975 Dreher et al. ..... 252/49.5
4,518,512 5/1985 Kanomori ..... 252/49.5
4,830,768 5/1989 Reich et al. ..... 252/49.3

FOREIGN PATENT DOCUMENTS 0252533 1/1988 European Pat. Off. .
1413137 11/1975 United Kingdom .

*Primary Examiner*—Christine Skane
*Attorney, Agent, or Firm*—Antonelli, Terry, Stout & Kraus

[57] ABSTRACT

Disclosed is an aqueous composition prepared by dispersing water in a base fluid in the presence of surfactants, which composition comprises, as the surfactants, (A) at least one of the compounds represented by the general formula:

$$R^1—O—(R^2—O)_n—H$$

wherein $R^1$ is an alkyl group having 3 to 10 carbon atoms, $R^2$ is an alkylene group having 2 or 3 carbon atoms, and n is an intefer of 1 to 20; however, when n is an integer of 2 or more, the repeating unit ($R^2$—O) may contain both of alkylene groups having 2 carbon atoms and alkylene groups having 3 carbon atoms mixedly, and (B) at least one ionic surfactant.

The aqueous composition of the present invention is transparent in appearance, and has a low viscosity, and can employ a fluid having a high viscosity to obtain a composition of desired viscosity. Said composition is also excellent in mechanical and chemical stabilities. In said composition, phase inversion by temperature is reversible.

10 Claims, 1 Drawing Sheet

FIG. 1

AQUEOUS COMPOSITION CONTAINING WATER DISPERSED IN A LUBRICATING BASE OIL AND AT LEAST TWO SURFACTANTS

This application is a continuation application of application Ser. No. 543,400, filed Jun. 26, 1990 now abandoned.

BACKGROUND OF THE INVENTION

1. Field of the Invention

The present invention relates to an aqueous composition, and more particularly to an aqueous composition which is useful as an aqueous lubricant, or an aqueous coolant, and is transparent in appearance.

2. Description of the Related Arts

Various aqueous lubricants have heretofore been known. Japanese Patent Publication No. 6991/1985, for instance, discloses an aqueous lubricant which is transparent in appearance, and has a high phase-inversion temperature and a high phase-reversibility.

However, the aqueous lubricant described in the above patent publication has a disadvantage in that the viscosity becomes high when it is in the form of transparent aqueous solution. Accordingly, in order to obtain a composition having a comparatively low viscosity, the lubricating base oil as the base fluid must be so low in viscosity that the lubricity cannot be sufficiently high. In addition, the aqueous lubricant described in the above publication is lacking for mechanical and chemical stabilities.

SUMMARY OF THE INVENTION

An object of the present invention is to provide an aqueous composition being transparent in appearance. and having a phase reversibility and a low viscosity, to which a base fluid having a high viscosity can be applied.

Another object of the present invention is to provide an aqueous composition as above, having mechanical and chemical stabilities.

The present invention provides, in an aqueous composition which is formed by dispersing water in a base fluid in the presence of surfactants, the improvement comprising, as the surfactants, (A) at least one of the compounds represented by the general formula (I):

$$R^1—O—(R^2—O)_n—H \quad (I)$$

wherein $R^1$ is an alkyl group having 3 to 10 carbon atoms, $R^2$ is an alkylene group having 2 or 3 carbon atoms, and n is an integer of 1 to 20, and when n is an integer of 2 or more, alkylene groups having 2 carbon atoms and alkylene groups having 3 carbon atoms may be mixed in the repeating unit ($R^2$—O), and (B) at least one ionic surfactant.

The present invention also provides an aqueous composition comprising the component (A), the component (B) and (C) at least one nonionic surfactant other than the component (A).

DESCRIPTION OF PREFERRED EMBODIMENTS

Figure 1:
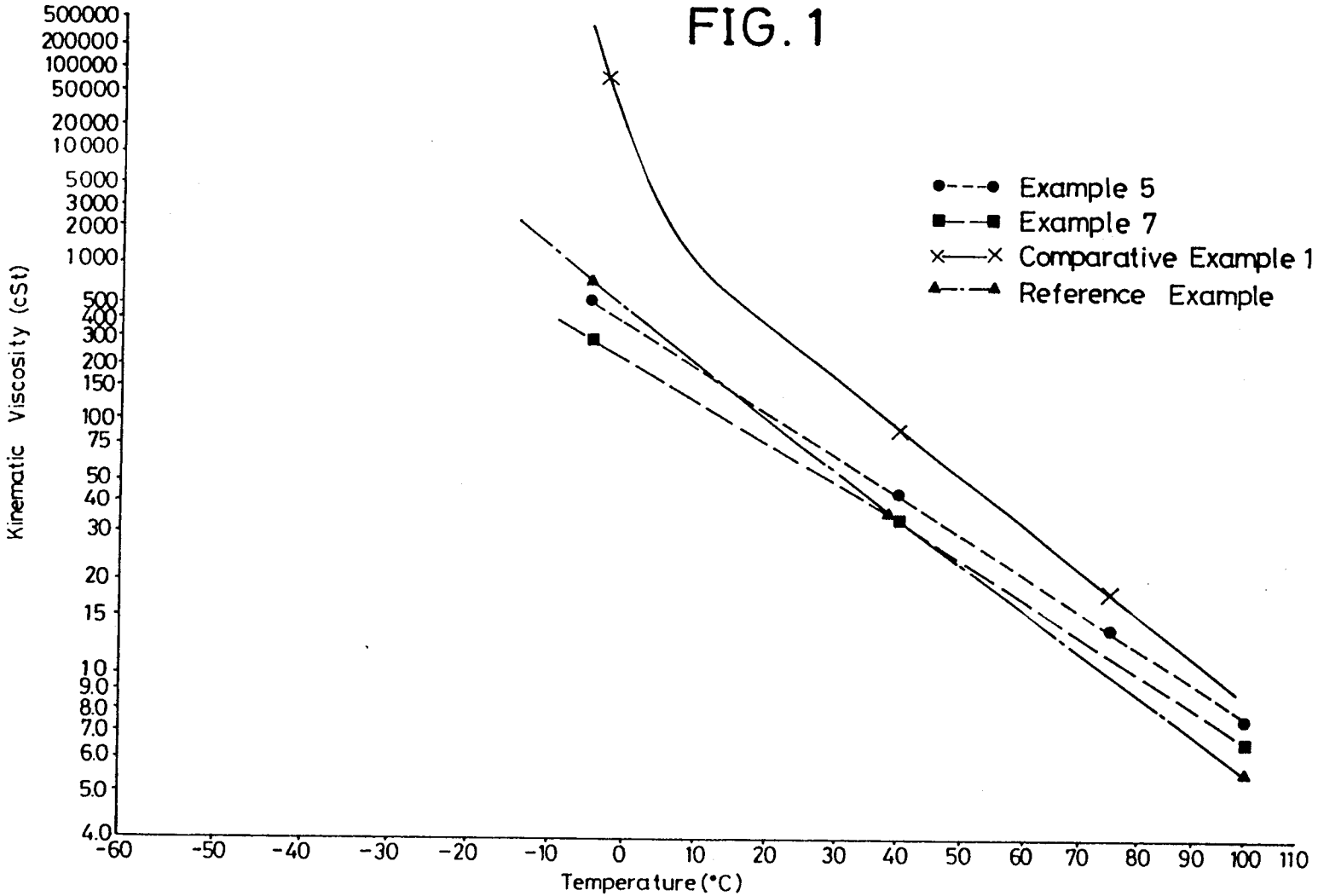
FIG. 1 shows the relations between viscosity and temperature of the aqueous composition in Examples 5 and 7, Reference Example, and Comparative Example 1.

The aqueous composition of the present invention is formed by dispersing water into a base fluid in the presence of a surfactant. Therein various base fluids can be used, as long as it is in liquid or semisolid form at ordinary temperature and has a melting point of 40° C or lower. Preferable base fluids are organic compounds which are in liquid form at ordinary temperature, and have a kinematic viscosity at 40° C. of 1 to 1000 cSt, and the most preferable ones among them are lubricating base oils having a kinematic viscosity at 40° C. of 2 to 500 cSt. Said lubricating base oil may be a mineral oil or a synthetic oil, and may contain, if necessary, various additives including an oiliness agent, an extreme-pressure agent, and an antioxidant. The composition of the present invention contains the above base fluid in the amount of usually 90% or less by weight, preferably 5 to 70% by weight, but said base fluid can comprised water only, without containing such a base fluid as above, that is, liquid organic compounds.

Then, the surfactant to be used in the present invention will be described as follows.

In the present invention, a compound represented by the general formula (I):

$$R^1—O—(R^2—O)_n—H \quad (I)$$

is used as component (A). Therein, $R^1$ is an alkyl group having 3 to 10 carbon atoms, including a propyl group, a butyl group, a pentyl group, a hexyl group, a heptyl group, an octyl group, a nonyl group, and a decyl group.

When $R^1$ is an alkyl group having 2 or less carbon atoms, the compound of the general formula (I) shows no emulsifying ability, and when $R^1$ is an alkyl group having 11 or more carbon atoms, the viscosity rises largely. Accordingly, both the cases are not suitable to the object of the present invention. n is an integer of 1 to 20, preferably 1 to 10, more preferably 1 to 5. $R^2$ is an alkylene group having 2 or 3 carbon atoms, and more specifically, an ethylene group or a propylene group. However, when n is an integer of 2 or more, both $R^2$ having 2 carbon atoms (ethylene group) and $R^2$ having 3 carbon atoms (propylene group) may exist in the repeating unit $R^2$—O). Among the compounds represented by the general formula (I), the most preferred one is a compound wherein $R^1$ is an alkyl group having 4 to 9 carbon atoms, $R^2$ is an alkylene group having 2 carbon atoms, and n is 1 to 5.

The compounds represented by the general formula (I) are preferably those having a hydrophilic-lipophilic balance (HLB) value of 3 to 15, more preferably 5 to 12. Specific examples of these compounds of general formula (I) are monobutylether, monohexylether, mono-n-octylether and mono-2-ethyl-hexylether of monoethylene glycol; monobutylether, monohexylether, mono-n-octylether and mono-2-ethyl-hexylether of diethylene glycol; monobutylether, monooctylether and mono-2-ethyl-hexylether of monopropylene glycol; monobutylether, monooctylether and mono-2-ethyl-hexylether of dipropylene glycol; monobutyl ether, monooctyl ether and mono-2-ethyl-hexylether of tripropylene glycol; monobutyl ether, monooctyl ether and mono-2-ethylhexylether of heptapropylene glycol; further, oxyethylene mono-2-ethyl-hexylethers such as tetraoxyethylene mono-2-ethyl-hexylether (n=4), and octaoxyethylene mono-2-ethylhexylether (n=8).

In the aqueous composition of the present invention, one or two kinds of the above compounds are used as component (A), but when two kinds or more are blended, it is preferred to blend the compounds whose HLB values are two or more apart from each other (for example, to blend a compound having a HLB value of 6 or less with a compound having a HLB value of 8 or more, or to blend a compound having a HLB value of 9 or less with a compound having a HLB value of 11 or more), or to use a compound having ($C_2H_4O$) unit and a compound having ($C_3H_6O$) unit in combination as the repeating unit ($R^2$—O).

The compounds represented by the general formula (I) are blended in the aqueous composition usually in the amount of 2 to 50% by weight, preferably 5 to 40% by weight.

The aqueous composition of the present invention contains further (B) ionic surfactant. Said ionic surfactant may be any of anionic, cationic, and amphoteric surfactants, and the specific examples of them are carboxylic acids having 7 to 40 carbon atoms, such as fatty acids having 7 to 30 carbon atoms, dimer acids of said fatty acids, dicarboxylic acids having 2 to 36 carbon atoms, metal salts of said carboxylic acids or alkanol amine salts of said carboxylic acids, metal salts of naphthenic acid, alkyl sulfates, alkyl sulfonates, alkylaryl sulfonates, amine salts, ammonium salts, amino acids and the like. One or more of them can be blended in the aqueous composition, and anionic surfactants are particularly preferable.

Ionic surfactants are blended in the aqueous composition of the present invention in an amount of 2 to 30% by weight usually, and preferably 3 to 20% by weight.

In the aqueous composition of the present invention, moreover, (C) nonionic surfactants other than the component (A) can be blended. Examples of the nonionic surfactants are (i) fatty acid esters of polyhydric alcohols, (ii) oxyalkylene ethers or polyoxyalkylene ethers and (iii) aliphatic alcohls. Oxyalkylene ethers or polyoxyalkylene ethers include the compounds wherein any of $R^1$ and $R^2$ is beyond the abovedescribed range, among the compounds represented by the general formula (I).

Specific examples of fatty acid esters of polyhydric alcohols are ethyleneglycol monolaurate, diethyleneglycol monolaurate, propyleneglycol monolaurate, propyleneglycol monostearate, stearic acid monoglyceride, oleic acid monoglyceride, sorbitan monostearate, sorbitan distearate, sorbitan tristearate, sorbitan monooleate, sorbitan sesquioleate, sorbitan dioleate, sorbitan trioleate, sorbitan monopalmitate and the like.

As oxyalkylene ether or polyoxyalkylene ether, used are the compounds represented by the general formula (II):

$$R^3—O—(R^4—O)_m—H \quad (II)$$

wherein R is an alkyl group having 12 to 30 carbon atoms, a phenyl group, an alkyl-substituted phenyl group having 7 to 30 carbon atoms, or a cycloalkyl group having 6 to 30 carbon atoms, $R^4$ is an alkylene group having 2 or 3 carbon atoms, and m is an integer of 1 to 20. However, when m is 2 or more, plural kinds of $R^4$s may exist in the repeating unit ($R^4$—O).

Specific examples of the compounds represented by the general formula (II) are polyoxyethylene laurylether, polyoxyethylene myristylether, polyoxyethylene cetylether, polyoxyethylene stearylether, polyoxyethylene nonylphenylether, and the like. Specific examples of the compounds other than the compounds of general formula (II) are polyoxyethylene butylether, hexylether, 2-ethylhexylether, nonylether, ethyleneglycol nonylether, decylether, and the like.

Further, the aliphatic alcohols therein are preferably those having 12 to 30 carbon atoms, such as lauryl alcohol, myristyl alcohol, cetyl alcohol and stearyl alcohol.

Nonionic surfactants as component (C) as above are not necessarily added, but if necessary, it is added usually in an amount of 2 to 30% by weight in the aqueous composition.

The aqueous composition of the present invention is formed by dispersing water into base fluid in the presence of a surfactant as mentioned above, and can contain generally 1 to 80% by weight, preferably 3 to 50% by weight of water. As described above, the base fluid can comprise water only, without a base oil such as mineral oil or synthetic oil.

In the aqueous composition of the present invention. additives such as water-soluble rust-preventives, antifleezing fluid, and the like can be added, if necessary, to the abovementioned components.

As water-soluble rust-preventives therein, conventional ones such as water-soluble rust preventives of nitrogen-containing organic compound, and water-soluble rust preventives of inorganic compound can be used optionally. Examples of them are alkyl amines such as tri-n-butylamine, and cyclohexyl amine; alkanol amines such as mono-(di- or tri-) ethanol amine, mono-(di- or tri-) propanol amine, n-butyldiethanol amine, diethyldiethanol amine, N-methyldiethanol amine, N-dibutyldiethanol amine and the like; amine compounds such as pyperazine, hydroxyethylpyperazine, morpholine and the like; above alkyl amine salts of carboxylic acids such as fatty acid having 6 to 20 carbon atoms, aromatic carboxylic acids, dibasic acids having 2 to 20 carbon atoms; above alkanol amine salts or ammonium salts; condensates of various carboxylic acids as above and amines; and inorganic salts such as sodium nitrite, cobalt nitrite, sodium carbonate and the like.

As the antifleezing fluid, ethylene glycol, propylene glycol and the like can be added, and thus the solidifying point (that is, the lowest temperature for application) of the aqueous composition can be lowered.

The aqueous composition of the present invention is obtained by blending and stirring the components as above, and formulated for lubricant, hydraulic fluid, coolant and so forth to be used in metal working such as cutting, and plasticizing, and thermal processing.

The working mechanism of the aqueous composition of the present invention in use for various purposes is not clear, but it is presumed that the molecule of surfactant forms micelles on the interface with the molecule of the base fluid, to be a protective colloid film.

In the present invention, a specific nonionic surfactant and an ionic surfactant and/or other nonionic surfactants are used in combination, and thus it is attained to obtain a transparent dispersing liquid containing a comparatively large amount of water in the base fluid.

The aqueous composition of the present invention is transparent in appearance, and has a low viscosity, and can employ a fluid having a high viscosity in order to obtain a composition having a desired viscosity. The aqueous composition of the present invention is excellent in mechanical and chemical stabilities, stability in storage, and stability in circulation, and hardly changes with temperature. Further, phase inversion by temperature or alteration of water content is reversible in said composition, so it can easily return to its original state.

Consequently, the aqueous composition of the present invention is suited to be aqueous lubricant such as metal working fluid, and oily agent for equipments, aqueous thermal medium, coolant and the like.

The present invention will be described in more detail with reference to the following Examples and Comparative Examples.

EXAMPLE 1 TO 9, COMPARATIVE EXAMPLES 1 TO 3, AND REFERENCE EXAMPLE

An aqueous composition was prepared by blending the components shown in Table 1 below in the proportions (by weight) shown in Table 1.

As the rust preventive, morpholine was used.

On the compositions of Examples 5 and 7, Reference Example and Comparative Example 1, the relation between viscosity and temperature were shown in FIG. 1.

Further, various properties of the resulting aqueous composition were determined according to the following methods and the results are shown in Tables 2 and 3.

(a) Kinematic Viscosity and Viscosity Index

Determined according to JIS K 2283.

(b) Clouding Point

Determined according to JIS K 2269.

(c) Shearing by Ultrasonic Wave

Determined according to MIL L H5606A, under the condition of 28 μm and 60 minutes.

(d) Heat Test

Heated at 200° C. for 36 hours sealed in an autoclave.

(e) Appearance

The sample was placed immediately into a glass vessel, and observed for its state at 20° C. at ordinary pressure. If the sample is dissolved, the solution becomes transparent and homogeneous.

(f) Temperature of Phase Inversion to Emulsion

A hundred milliliters of sample was placed in 200 ml-beaker and heated with stirring from ordinary temperature to 100° C. for about 5 minutes. State of the sample therein was observed. The temperature at which the sample becomes cloudy emulsion was taken as the phase inversion temperature. The phase inversion temperature is more favorable, the higher it is.

(g) State of the Process of Moisture Evaporation

A hundred milliliters of sample was placed into 200 ml-beaker, heated with stirring to 90° to 100° C., and its state after 30 minutes were observed. Stirring was performed at 200 rpm. The composition was evaluated by judging whether it was "liquid" or "solidified".

(h) Reversibility of Phase Inversion

It was judged whether the sample phase-inverted by the operation (f) or (g) could return to the state before phase inversion.

(1) After the test (g), water in the same amount as lost in the evaporation was added to the sample, and stirred at 200 rpm at 20° C. at ordinary pressure for 10 minutes, and tested if it could return to the state just after it was produced.

The result was indicated as "reversible" when the composition returned to the state, and "irreversible" when it did not.

(2) After the test (f), the sample was heated to 100° C., and then left to cool with stirring at 200 rpm. In the case where the phase inversion temperature had been determined by the operation (f), if it returned to the state before phase inversion around the temperature (±10° C.) to be similar in appearance at 20° C. to that of (e), it was indicated as "reversible", while if not, it was indicated as "irreversible". When the phase inversion temperature had not been determined by the operation (f), the sample in cooling was observed in the same manner. When no phase inversion was observed in cooling, and the appearance on returning to 20° C. was similar to that of (e), it was judged as "reversible", and if not, as "irreversible".

(i) Stability in Storage: Appearance of Test Piece

Into 200 ml-glass vessel (with stopper) having inner diameter of 25 mm and height of 150 mm, 150 ml of test sample was placed. In the said sample, a test piece made of SPCC (cold-stretched steel plate) with a thickness of 1 mm, width of 20 mm, and length of 120 mm was placed. The vessel was closed with the stopper, and left for 6 months at a constant temperature of 20° C., and after that, the rust on the surface of test piece was judged. The result was indicated as "unchanged" when no rust was formed, and "rust" when rust was formed.

(j) Stability in Storage: Appearance of the fluid

After the test (i), the sample was observed for its state. The sample composition was observed whether it was transparent and homogeneous.

(k) Stability in Circulation

A circulation test by gear pump for one month was performed, and then the tests (e) to (h) as above were carried out. If the sample was in the same state as that just after production, the result was indicated as "good", and if not, indicated as "no good". The test was carried out at tank temperature of 50° C., with a capacity of 20 liters, at a flow rate of pump of 4 liters/min., and the water content was supplemented by an automatic water supplying apparatus to keep a fixed value.

(l) Anti-wear Property Test

A pump test was carried out at 140 kg/cm$^2$ at 50° C. for 250 hours according to ASTM D 2882.

TABLE 1

| | Example | | | | | | | Reference | Comparative Example | | | Example | |
|---|---|---|---|---|---|---|---|---|---|---|---|---|---|
| Composition | 1 | 2 | 3 | 4 | 5 | 6 | 7 | Example | 1 | 2 | 3 | 8 | 9 |
| Liquid Component | | | | | | | | | | | | | |
| Mineral oil (Kinematic viscosity at 40° C.: 8 cSt) | — | — | — | — | — | — | — | — | — | 50 | 35 | — | — |
| Mineral oil (Kinematic viscosity at 40° C.: 20 cSt) | 46 | 47.5 | 48.5 | 52 | 46 | 49 | 42 | — | 48 | — | — | — | — |
| Mineral oil (Kinematic viscosity at 40° C.: 36 cSt) | — | — | — | — | — | — | — | 100 | — | — | — | 37 | 15 |
| Component (A) | | | | | | | | | | | | | |
| POE-butylether (n = 2) | 6 | — | — | — | — | — | — | — | — | — | — | 15*1 | 10*1 |
| POE-hexylether (n = 2) | — | 10 | 8.5 | — | — | — | — | — | — | — | — | 3*2 | |
| POE-2-ethylhexylether (n = 2) | — | — | — | 11 | 14 | 11 | 14 | — | — | — | — | 5 | 20 |
| POE-2-ethylhexylether (n = 4) | — | — | — | — | — | 5 | 9 | — | — | — | — | — | — |

TABLE 1-continued

| Composition | Example 1 | 2 | 3 | 4 | 5 | 6 | 7 | Reference Example | Comparative Example 1 | 2 | 3 | Example 8 | 9 |
|---|---|---|---|---|---|---|---|---|---|---|---|---|---|
| Component (B) | | | | | | | | | | | | | |
| Petroleum Sulfonate | 6 | 6.5 | — | 6 | — | — | — | — | 5 | 5 | 5 | — | — |
| Potassium Oleate | — | — | 5 | — | 8 | 6 | 6 | — | — | — | — | 10 | 15 |
| Capric acid diethanol amine salt | 1 | 2 | — | — | — | — | — | — | 1 | 1 | 1 | — | — |
| Component (C) | | | | | | | | | | | | | |
| POE-nonylphenylether (n = 2) | 5 | 7 | 12 | 5 | 5 | 8 | 8 | — | 12 | 10 | 10 | — | — |
| POE-nonylphenylether (n = 4) | 5 | 6 | 5 | 5 | 8 | — | — | — | 5 | 5 | 10 | — | — |
| POE-nonylphenylether (n = 9) | — | — | — | — | — | — | — | — | 8 | 8 | 18 | — | — |
| Rust Preventive | 1 | 1 | 1 | 1 | 1 | 1 | 1 | — | 1 | 1 | 1 | — | — |
| Water | 20 | 20 | 20 | 20 | 20 | 20 | 20 | — | 20 | 20 | 20 | 30 | 40 |

*1POE-2-ethylhexylether (n = 1)
*2POE-2-ethylhexylether (n = 3)
POE shows polyoxyethylene group, POP shows polyoxypropylene group, respectively, and n is the number of the repeating unit therein

TABLE 2

| | Example 1 | 2 | 3 | 4 | 5 | 6 | 7 |
|---|---|---|---|---|---|---|---|
| Kinematic Viscosity (cSt) 40° C. | 49 | 51 | 45 | 48 | 47 | 40 | 36 |
| Kinematic Viscosity (cSt) −5° C. | 630 | 890 | 502 | 645 | 544 | 381 | 301 |
| Kinematic Viscosity (cSt) 100° C. | 6.8 | 8.4 | 7.8 | 6.7 | 8.0 | 7.1 | 6.9 |
| Viscosity Index | 90 | 139 | 144 | 90 | 141 | 136 | 159 |
| Clouding Point | −15 | −15 | −15 | −8 | −14 | −15 | −15 |
| Kinematic Viscosity containing 40% water (40° C.) (cSt) | — | — | 85 | 86 | 90 | 82 | 71 |
| Kinematic Viscosity after shearing by ultrasonic wave (40° C.) (cSt) | — | — | — | 49 (2%) | 47 (0%) | 40 (0%) | 36 (0%) |
| Kinematic Viscosity after heat test (40° C.) (cSt) | — | — | — | — | 47 (0%) | 40 (0%) | 36 (0%) |
| Appearance | Transparent and homogeneous | | | | | | |
| Temperature of Phase Inversion into Emulsion (°C.) | >100 | >100 | >100 | >100 | >100 | >100 | >100 |
| State in the process of water evaporation | L*3 | L*3 | L*3 | L*3 | L*3 | L*3 | L*3 |
| Reversibility of Phase Inversion | Re*4 | Re*4 | Re*4 | Re*4 | Re*4 | Re*4 | Re*4 |
| Stability in storage | | | | | | | |
| Appearance of test piece | Unchanged | | | | | | |
| Appearance of fluid | Unchanged | | | | | | |
| Stability in circulation | good | good | good | good | good | good | good |

| | Reference Example | Comparative Example 1 | 2 | 3 | Example 8 | 9 |
|---|---|---|---|---|---|---|
| Kinematic Viscosity (cSt) 40° C. | 36 | 90 | 50 | 73 | 43 | 64 |
| Kinematic Viscosity (cSt) −5° C. | 750 | 8000 | 1000 | 5000 | 490 | 980 |
| Kinematic Viscosity (cSt) 100° C. | 5.6 | 9.4 | 6.6 | 9.3 | 6.3 | 9.0 |
| Viscosity Index | 90 | 75 | 77 | 103 | 91 | 116 |
| Clouding Point | −15 | 0 | 0 | 0 | −5 | −5 |
| Kinematic Viscosity containing 40% water (40° C.) (cSt) | — | 140 | 93 | 104 | 82 | 64 |
| Kinematic Viscosity after shearing by ultrasonic wave (40° C.) (cSt) | — | 95 (5.6%) | 54 (8%) | 86 (17.8%) | 43 (0%) | 64 (0%) |
| Kinematic Viscosity after heat test (40° C.) (cSt) | — | 97 (7.8%) | No | 89 (22%) | 43 (0%) | 64 (0%) |
| Appearance | Transparent and homogeneous | | | | | |
| Temperature of Phase Inversion into Emulsion (°C.) | — | >100 | >100 | >100 | >100 | >100 |
| State in the process of water evaporation | — | L*3 | L*3 | L*3 | L*3 | L*3 |
| Reversibility of Phase Inversion | — | Re*4 | Re*4 | Re*4 | Re*4 | Re*4 |
| Stability in storage | | | | | | |
| Appearance of test piece | — | Unchanged | | | | |
| Appearance of fluid | — | Unchanged | | | | |
| Stability in circulation | — | good | good | good | good | good |

*3liquid
*4reversible

TABLE 3

| Wear amount | Example 4 | Example 5 | Comparative Example 1 | Commercial Product Water-Glycol | Reference Example |
|---|---|---|---|---|---|
| Cam ring (mg) | 213 | 28 | 570 | 976 | 198 |
| Vane (mg) | 11 | 5 | 13 | 28 | 8 |
| Total | 223 | 33 | 583 | 1004 | 206 |

TABLE 3-continued

| Wear amount | Example 4 | Example 5 | Comparative Example 1 | Commercial Product Water-Glycol | Reference Example |
|---|---|---|---|---|---|
| (mg) | | | | | |

The results given in the above tables show the following facts.

(i) The aqueous composition of the present invention has a lower kinematic viscosity than those of the conventional ones (kinematic viscosity at −5° C., 40° C. of Comparative Example 1), even if a base fluid having the same kinematic viscosity. Particularly, as shown in Examples 6 and 7, when plural compounds of general formula (I) are added, the viscosity of the aqueous composition is desirably lowered. In the conventional composition, on the other hand, even if the kinematic viscosity of the base fluid is lowered, the resulting kinematic viscosity becomes not so low (see Comparative Examples 2 and 3).

(ii) The aqueous composition of the present invention has a high viscosity index. As seen from FIG. 1, the lines representing the kinematic viscosities of the compositions in Examples 5 and 7 show small inclinations on the graph, and are on the side indicating lower viscosity. That means, the composition of the present invention has a low viscosity, and is small in change with temperature. On the other hand, in the compositions of Comparative Examples 1 to 3 and Reference Example, the kinematic viscosities vary with temperature largely, and the viscosities rise remarkably in the range of lower temperature.

(iii) The composition of the present invention shows little change in viscosity after being sheared and after heat test (see Examples 4 to 7, and Comparative Examples 1 to 3).

(iv) In the composition of the present invention, wear amount resulting in anti-wear properties test by pump is small. Particularly, the composition of Example 5 is far superior to the mineral base oil (see Reference Example) in anti-wear properties.

(v) In the composition of the present invention, it is possible to obtain an aqueous solution being low in viscosity and stable, if the amount of water blended is 30% by weight or 40% by weight (see Examples 8 and 9).

What is claimed is:

1. In an aqueous composition formed by dispersing water into 5 to 70% by weight of a lubricating base oil having a kinematic viscosity at 40° C. of 2 to 500 cSt in the presence of surfactants, the improvement comprising, as the surfactants, (A) 2 to 50% by weight of at least two kinds of the compounds represented by the general formula (I):

$$R^1—O—(R^2—O)_n—H \quad (I)$$

wherein $R^1$ is an alkyl group having 3 to 10 carbon atoms, $R^2$ is an alkylene group having 2 or 3 carbon atoms, and n is an integer of 1 to 20, and when n is an integer of 2 or more, the repeating unit ($R^2$—O) may contain both of alkylene groups having 2 carbon atoms and alkylene groups having 3 carbon atoms, the HLB values of at least two kinds of the compounds being two or more apart from each other, and (B) 2 to 30% by weight of at least one ionic surfactant selected from the group consisting of sulfonates, carboxylic acids, metal salts of carboxylic acids and alkanolamine salts of carboxylic acids said composition containing 1 to 80% by weight of water.

2. In an aqueous composition formed by dispersing water into 5 to 70% by weight of a lubricating base oil having a kinematic viscosity at 40° C. of 2 to 500 cSt in the presence of surfactants, the improvement comprising, as the surfactants, (A) 2 to 50% by weight of at least two kinds of the compounds represented by the general formula (I):

$$R^1—O—(R^2—O)_n—H \quad (I)$$

wherein $R^1$ is an alkyl group having 3 to 10 carbon atoms, $R^2$ is an alkylene group having 2 or 3 carbon atoms, and n is an integer of 1 to 20, and when n is an integer of 2 or more, the repeating unit ($R^2$—O) may contain both of alkylene groups having 2 carbon atoms and alkylene groups having 3 carbon atoms, the HLB values of at least two kinds of the compounds being two or more apart from each other, and (B) 2 to 30% by weight of at least one of petroleum sulfonate, potassium oleate and capric acid diethanol amine salt; said composition containing 1 to 80% by weight of water.

3. In an aqueous composition formed by dispersing water into 5 to 70% by weight of a lubricating base oil having a kinematic viscosity at 40° C. of 2 to 500 cSt in the presence of surfactants, the improvement comprising, as the surfactants, (A) 2 to 50% by weight of at least two kinds of the compounds represented by the general formula (I):

$$R^1—O—(R^2—O)_n—H \quad (I)$$

wherein $R^1$ is an alkyl group having 3 to 10 carbon atoms, $R^2$ is an alkylene group having 2 or 3 carbon atoms, and n is an integer of 1 to 20, and when n is an integer of 2 or more, the repeating unit ($R^2$—O) may contain both of alkylene groups having 2 carbon atoms and alkylene groups having 3 carbon atoms, the HLB values of at least two kinds of the compounds being two or more apart from each other, 2 to 30% by weight of at least one ionic surfactant selected from the group consisting of sulfonates, carboxylic acids, metal salts of carboxylic acids and alkanolamine salts of carboxylic acids, and (C) 2 to 30% by weight of at least one nonionic surfactant other than the component (A); said composition containing 1 to 80% by weight of water.

4. In an aqueous composition formed by dispersing water into 5 to 70% by weight of a lubricating base oil having a kinematic viscosity at 40° C. of 2 to 500 cSt in the presence of surfactants, the improvement comprising, as the surfactants, (A) 2 to 50% by weight of at least one of the compounds represented by the general formula (I):

$$R^1—O—(R^2—O)_n—H \quad (I)$$

wherein $R^1$ is an alkyl group having 3 to 10 carbon atoms, $R^2$ is an alkylene group having 2 or 3 carbon atoms, and n is an integer of 1 to 20, and when n is an integer of 2 or more, the repeating unit ($R^2$—O) may contain both of alkylene groups having 2 carbon atoms and alkylene groups having 3 carbon atoms, (B) 2 to 30% by weight of at least one of petroleum sulfonate, potassium oleate and capric acid diethanol amine salt, and (C) 2 to 30% by weight of at least one nonionic surfactant other than the component (A); said composition containing 1 to 80% by weight of water.

5. In an aqueous composition formed by dispersing water into 5 to 70% by weight of a lubricating base oil having a kinematic viscosity of 40° C. of 2 to 500 cSt in the presence of surfactants, the improvement comprising, as the surfactants, (A) 2 to 50% by weight of at least one of the compounds represented by the general formula (I):

$$R^1—O—(R^2—O)_n—H \quad (I)$$

wherein $R^1$ is an alkyl group having 3 to 10 carbon atoms, $R^2$ is an alkylene group having 2 or 3 carbon atoms, and n is an integer of 1 to 20, and when n is an integer of 2 or more, the repeating unit ($R^2$—O) may contain both of alkylene groups having 2 carbon atoms and alkylene groups having 3 carbon atoms, (B) 2 to 30% by weight of at least one of petroleum sulfonate, potassium oleate and capric acid diethanol amine salt, and (C) 2 to 30% by weight of at least one polyoxyethylenenonylphenylether; said composition containing 1 to 80% by weight of water.

6. In an aqueous composition formed by dispersing water into 5 to 70% by weight of a lubricating base oil having a kinematic viscosity at 40° C. of 2 to 500 cSt in the presence of surfactants, the improvement comprising, as the surfactants, (A) 2 to 50% by weight of at least one the compounds represented by the general formula (I):

$$R^1—O—(R^2—O)_n—H \quad (I)$$

wherein $R^1$ is an alkyl group having 3 to 10 carbon atoms, $R^2$ is an alkylene group having 2 or 3 carbon atoms, and n is an integer of 1 to 20, and when n is an integer of 2 or more, the repeating unit ($R^2$—O) may contain both of alkylene groups having 2 carbon atoms and alkylene groups having 3 carbon atoms, (B) 2 to 30% by weight of at least one ionic surfactant, selected from the group consisting of sulfonates, carboxylic acids, metal salts of carboxylic acids and alkanolamine salts of carboxylic acids, and (C) 2 to 30% by weight of at least one polyoxyethylenenonylphenylether; said composition containing 1 to 80% by weight of water.

7. The aqueous composition of claim 1, wherein said composition contains 3 to 50% by weight of water.

8. The aqueous composition of claim 2, wherein said composition contains 3 to 50% by weight of water.

9. The aqueous composition of claim 3, wherein said composition contains 3 to 50% by weight of water.

10. The aqueous composition of claim 4, wherein said composition contains 3 to 50% by weight of water.

* * * * *